United States Patent [19]

Lendvay et al.

[11] 4,256,123

[45] Mar. 17, 1981

[54] SMOKABLE MATERIAL CONTAINING THERMALLY DEGRADED TOBACCO BY-PRODUCTS AND ITS METHOD OF PREPARATION

[75] Inventors: Andrew T. Lendvay; Helmut R. R. Wakeham; Gus D. Keritsis, all of Richmond, Va.

[73] Assignee: Philip Morris Incorporated, New York, N.Y.

[21] Appl. No.: 930,331

[22] Filed: Aug. 2, 1978

[51] Int. Cl.[3] ..... A24B 3/14; A24B 15/18; A24D 1/18

[52] U.S. Cl. ..... 131/17 A; 131/140 C

[58] Field of Search ..... 131/17, 2, 15 R, 15 C, 131/140 C

[56] References Cited

U.S. PATENT DOCUMENTS

| | | | |
|---|---|---|---|
| 3,297,039 | 1/1967 | Osborne et al. | 131/140 C |
| 3,529,602 | 9/1970 | Hind et al. | 131/140 C |
| 3,818,915 | 6/1974 | Anderson | 131/2 |
| 3,844,294 | 10/1974 | Webster | 131/2 |
| 3,844,543 | 7/1975 | Anderson et al. | 131/2 |
| 3,885,575 | 5/1975 | Parker et al. | 131/2 |
| 4,014,348 | 3/1977 | Garner | 131/2 |
| 4,131,118 | 12/1978 | Gellatly | 131/140 C |
| 4,133,317 | 1/1979 | Briskin | 131/2 |

FOREIGN PATENT DOCUMENTS

| | | | |
|---|---|---|---|
| 735353 | 6/1973 | South Africa | 131/2 |
| 1362613 | 8/1974 | United Kingdom | 131/2 |
| 1362751 | 8/1974 | United Kingdom | 131/2 |

OTHER PUBLICATIONS

Wynder & Hoffman, *Tobacco and Tobacco Smoke,* pp. 42–58, Academic Press, 1967, N.Y. N.Y.

*Primary Examiner*—V. Millin

*Attorney, Agent, or Firm*—Watson, Leavenworth, Kelton & Taggart

[57] ABSTRACT

A method of producing a smokable material containing tobacco by-products, such as stems or stalks, having reduced particulate matter, particularly, tar and nicotine, and which additionally has no undesirable "woody taste" is disclosed. The method for producing this smokable material comprises subjecting tobacco by-products material to pyrolysis, adding the pyrolyzed material to a tobacco-parts slurry, homogenizing the slurry, drying and processing the resultant reconstituted product to a form desired for the smoking material. The smoking material obtained by such method is also described.

22 Claims, No Drawings

SMOKABLE MATERIAL CONTAINING THERMALLY DEGRADED TOBACCO BY-PRODUCTS AND ITS METHOD OF PREPARATION

BACKGROUND OF THE INVENTION

This invention pertains to the field of smoking materials. More particularly, the present invention concerns a method for preparing a smoking material containing tobacco stem and/or stalk materials having reduced tar, nicotine and puff count while having no undesirable "woody taste".

As a result of the stripping of leaf tobacco in preparation for its use for cigar wrappers or filler, cigarettes and smoking tobacco, tobacco by-products, such as, stems, stalks and leaf scraps are collected. These by-products have not been very useful for direct incorporation in smoking products, although some have been used for making snuff and for mixture with chewing tobacco. Tobacco dust and the like have also been recovered resulting from shipping and handling of tobacco. Although attempts have been made in the past to economically utilize these tobacco by-products by forming "reconstituted" tobacco therefrom (see, for example, U.S. Pat. Nos. 3,409,026 and 3,386,449), such reconstituted tobacco has frequently been found to be undesirable due to the harshness, poor aromatic qualities and off-taste of the smoke produced by this material even when it is combined with natural leaf tobacco and used in very small quantities. This is particularly true where attempts have been made to utilize Burley tobacco by-products.

Moreover, even though reconstituted tobacco is made from tobacco by-products, it nevertheless possesses some of the same characteristics as natural leaf tobacco. Accordingly, it would be highly desirable to develop a method by which the less desirable constituents of a reconstituted tobacco are reduced while the flavor and aromatic properties are improved.

The reduction of tar and nicotine in tobacco leaf material has been attempted by incorporating a carbohydrate or cellulosic material which has been thermally degraded or "pyrolyzed" in an inert atmosphere into the tobacco. Such techniques are disclosed, for example, in U.S. Pat. Nos. 3,861,401, 3,861,402 and 4,019,521. Another technique described in U.S. Pat. No. 3,805,803 discloses a method by which the tar and nicotine content of a reconstituted tobacco smoking material is reduced by the incorporation of activated carbon.

The above techniques suffer from many disadvantages. In particular, they generally all require the addition of materials which are foreign to tobacco. These foreign materials may detract from and adversely affect the acceptability of the smoking product which contains such additives.

SUMMARY OF THE INVENTION

Applicants have discovered a method for producing a smokable material which economically utilizes tobacco by-product material, particularly, stems and stalks, which material not only has no undesirable "woody taste" or the harshness and undesirable aromatic qualities of prior art products which utilize such tobacco by-products, but additionally, produces a smokable material which has reduced particulate matter, particularly tar and nicotine, and reduced puff count.

More importantly, Applicants have discovered a method which avoids substantially all of the above-noted disadvantages inherent in prior art processes. Thus, the smokable material of the present invention is composed of 100% tobacco plant material and does not require the use of foreign, non-tobacco material in order to obtain the desired objectives. This invention makes possible the utilization of tobacco by-product materials, such as stems and stalks, while at the same time, removing the undesirable "woody taste" normally associated with such materials and additionally reduces the resulting total particulate matter when smoked.

More particularly, the present invention is directed to a method of producing a smokable material which comprises subjecting tobacco by-product material to pyrolysis, adding the pyrolyzed material to a tobacco-parts slurry, homogenizing the slurry, and processing the resultant reconstituted product to a form desired for the smoking material.

Quite unexpectedly, the process of the present invention produces a smoking material which has a tar and nicotine content in the mainstream smoke equal to or less than that associated with tobacco materials containing either heat treated cellulosic materials or activated carbon. This phenomenon, in conjunction with the fact that 100% tobacco plant material is being used in lieu of foreign additives, produces a highly desirable product, not only from an economic point of view, but also from a marketing consumer point of view.

This invention produces a smokable material which is low in cost, makes use of so-called "by-product" materials to form a commercially acceptable product and is produced in a simple and efficient manner.

DETAILED DESCRIPTION OF THE INVENTION

The method of producing the smokable material of the present invention is generally carried out as follows:

Tobacco by-product material is first pyrolyzed. Although tobacco by-product material generally includes tobacco fines, dust, stems and stalks, the process of the present invention is most advantageously used with tobacco stems and stalks inasmuch as it is these materials which, above all, produce the undesirable characteristics of reconstituted tobacco when these particular materials are contained therein. This method is particularly suitable for Burley stem and stalk material.

Generally, the tobacco by-product material is pyrolyzed by subjecting the material to thermal degradation at a temperature of about 150° C. to 700° C. for periods ranging from ½ minute to 72 hours or more, depending on the treatment temperature and the weight loss desired. Preferably, however, the temperature is between 250° C. and 500° C. and the residence time is from about one minute to about two hours.

The heating of tobacco by-product material may take place in an oxidizing atmosphere, such as air, provided the heat treatment is carried out in a closed environment up to a temperature of about 450° C. or may alternatively be carried out in an inert atmosphere such as nitrogen, carbon dioxide, helium and the like. Preferably, beyond a temperature of 450° C., only an inert atmosphere will be employed. This is to ensure that oxidation or burning of the tobacco by-product material does not take place, but rather, only pyrolytic degradation.

In lieu of the inert atmosphere, the non-oxidation condition may also be acquired by carrying out the thermal degradation under vacuum conditions.

Heating for the pyrolysis step may be derived from any convenient source such as, for example, radiant heat, gas heat, oil heat, steam, electricity, microwave energy, and the like.

The pyrolysis is carried out to the extent that the tobacco by-product experiences a weight loss of from about 40 to 90% on a dry weight basis and preferably from about 45 to 70%. Generally, Applicants have noted that the higher the weight loss of the tobacco by-product material, the better is the resultant reduction in particulate material. However, it is not desirable to pyrolyze the material to such an extent that the accumulation of non-volatile ash components is such that it produces a mainstream smoke which may be too harsh.

During pyrolysis, it may be desirable, although certainly not critical to the present invention, to remove volatile organic materials that are produced as a result of the pyrolysis. Such removal of the organic materials may be accomplished by, for example, vacuum means. Alternatively, the volatiles may be removed by maintaining the pyrolysis chamber under positive pressure such that the volatile materials are forced out of the chamber. Removal of these volatile materials prevent the possibility of their condensing back onto the pyrolyzed tobacco by-product material. It is believed that the removal of these volatile organic materials aids in the production of a better tasting and more aromatic product. Although such a step is desirable, it certainly is not necessary in the process of the present invention.

The tobacco by-product material can be subjected to the thermal degradation process in the form of powders or discrete particles such as shreds, but it is preferred to carry out the described thermal treatment while the tobacco by-product material is in chip form.

In a batch operation, the material is simply loaded into an enclosed chamber in which the specific pyrolytic conditions are provided. Thereafter, the material is heated to the temperature for thermal degradation and maintained at such temperature for the desired length of time. It is preferable, however, in order to reduce the costs involved, to carry out the thermal treatment in a continuous manner wherein the tobacco by-product material is placed on a moving conveyor belt which passes through the enclosed heated chamber at a rate sufficient to achieve the desired degree of thermal degradation.

Where desired, prior to carrying out the pyrolysis step upon the tobacco by-product material, the material may optionally be water extracted to remove water soluble constituents therefrom. With Burley stem tobacco material, it is particularly desirable to reduce the potassium salts contained therein, e.g., potassium nitrate. It is believed that these potassium salts are generally undesirable in the final smoking product in that they contribute to a harsher smoke having more impact on delivery. However, in some instances, it may be desirable not to extract these salts. Thus, it is well-known that potassium is a potent combustion catalyst. Consequently, the smoking material in which the potassium is present, burns more rapidly between puffs. Accordingly, the number of puffs per cigarette is greatly reduced. This inherently leads to a reduction of the total amount of tar and nicotine consumed by the user which is quite desirable. Additionally, the presence of the potassium salts might be preferred in a situation where the amount of pyrolyzed tobacco by-product material is to be used in a very dilute quantity and yet be able to deliver a smoking product which has some impact on delivery. Thus, the step of prewashing the tobacco by-product materials prior to pyrolysis to extract the water solubles therefrom is dependent on the end product desired. After the water extraction step, the potassium salts may be removed from the extract and, if desired, the remaining water soluble constituents recombined with either the tobacco-parts slurry or alternatively, with the final reconstituted tobacco sheet web containing the pyrolyzed tobacco by-products.

The water extraction step is generally carried out by simply washing the tobacco by-product material in a manner which is conventional in the art and well within the knowledge of the ordinary skilled art worker.

Subsequent to the pyrolysis of the tobacco by-product material, it is desirable, although not critical to the present invention, to immediately cool the pyrolyzed material prior to it being exposed to the air. This is done to prevent the possibility of the still hot pyrolyzed tobacco by-product material from oxidizing as a result of being exposed to the oxygen in the air. Thus, it is preferable that the pyrolyzed tobacco by-product material, upon emerging from the pyrolysis chamber be cooled by such means as immersion in a chamber containing dry ice or, alternatively, passing cold nitrogen gas over the material. If desired, the pyrolyzed material may simply be dropped into cold water or into a tobacco parts slurry which is more fully discussed hereinafter. Any other conventional method for cooling the material may also be used.

The cool, pyrolyzed tobacco by-product material is then preferably pulverized in a manner conventional in the art. Where, for example, the pyrolyzed material was cooled by immersion into cold water, it may be pulverized by subsequent wet grinding. The material is pulverized for convenience such that it can be more uniformly dispersed throughout the tobacco-parts slurry or a liquid stock of tobacco fibers to which it is subsequently added. Although it is desirable to pulverize the pyrolyzed material prior to its being added to the tobacco-parts slurry, it is not critical. Thus, it is also possible to add the pyrolyzed material to the slurry without being previously pulverized. In this manner, upon subsequent homogenization of the slurry, the pyrolyzed tobacco material is "wet ground" by means of this homogenization step.

Where desirable, the process of the present invention can also be carried out by first pulverizing the tobacco by-product material and then subjecting it to pyrolysis.

The tobacco-parts slurry used in the present invention is prepared by any of the processes well known in the art for preparing reconstituted tobacco. (See, for example, U.S. Pat. No. 3,409,026 incorporated herein by reference.) In general, the tobacco-parts slurry is formed in the following manner. Tobacco by-product materials, such as stems, dust and fines are first ground. This ground tobacco material is then mixed with water to form a slurry. A reconstituted tobacco sheet is formed from this slurry either by a papermaking process, casting the slurry, or by extrusion. Of course, other reconstitution processes which are well-known in the art may also be used.

The pyrolyzed tobacco by-product material is now added to the tobacco-parts slurry. The slurry is thereafter homogenized such that a thorough blending of the components takes place to form a uniform homogeneous mixture.

More particularly, the homogenization of the slurry results in a product with more pleasing appearance. More importantly, it provides the product with uniform burning characteristics which is highly desirable. The homogenization is typically carried out in apparatus such as, for example, Waring blenders, Valley beaters, plate refiners, Hammermill or Cowles dissolvers, and the like. Naturally, the efficiency of these apparatuses will vary and the time necessary to achieve the proper homogenization will correspondingly also vary.

Typically, about 0.1% to 75.0% and preferably about 0.8% to 60.0% of the pyrolyzed tobacco by-product material is added to the slurry based on the weight of the tobacco material employed in said slurry. Applicants have found that the greater the amount of pyrolyzed tobacco by-product material used, the greater the reduction of particulate matter associated with the smokable material produced. However, an excess of the pyrolyzed material is undesirable inasmuch as the flavor and aromatic characteristics of the smoking material are reduced when the amount of reconstituted tobacco is proportionately decreased. Consequently, the maximum amount of pyrolyzed tobacco by-product material that can effectively be added to the tobacco-parts slurry and yet produce a reconstituted product which possesses the desirable properties and characteristics of natural tobacco is about 75.0% based on the total dry weight of the slurry.

The homogenized slurry is thereafter processed to form the desired smoking material. If desired, the slurry may be cast directly, dried and cut into particulate material similar in physical form to ordinary smoking tobacco and so used, mixed with tobacco leaf, cut or shredded in the usual manner. The product may be cast in sheet form, in blocks or as threads or other shapes, as desired. When in the form of a sheet or strip, the smokable material can be split into thin strips for twisting or intertwisting with other strips to form strands which can be cut into lengths suitable for use in filling machines for the fabrication of cigars, cigarettes or as a pipe tobacco substitute. The strands of the smokable material so produced can be used alone, or if desired, can be intertwisted with strands of natural tobacco for admixture therewith in various proportions to produce a smokable material.

Generally, the sheets are cast to a thickness of about 10 to 50 mils. The sheets are then dried at a temperature of about 100° to 180° C. to a moisture content of about 3 to 18%. Methods of forming continuous sheets of reconstituted tobacco are generally known in the art and further details need not be described here. Representative of this type of procedure is disclosed in U.S. Pat. No. 2,734,513, incorporated herein by reference. The sheet, when dried, is generally darkish brown in color and resembles toasted coffee in both color and aroma.

Alternatively, the reconstituted sheet material may be prepared by a typical paper-making process. The usual procedure is to feed the homogenized slurry containing the pyrolyzed by-products to the headbox of a paper-making machine from which the reconstituted sheet is prepared.

The smoking material produced by the present invention has reduced tar and nicotine, reduced puff count, and has no "woody taste" as is prevalent in prior art processes. In fact, the smokable material of the present invention, according to the subjective evaluations of some smokers, has better flavor and aromatic qualities than smoking materials which contain no tobacco by-product material at all. More importantly, however, is the fact that the present invention produces a smoking material which is completely derived from tobacco plant material and no undesirable foreign additives are added thereto.

Having described the basic concepts of this invention, the following examples are being set forth to illustrate the same. They are not, however, to be construed as limiting the invention in any manner. All parts and percentages in the examples are by weight.

EXAMPLE 1

100 grams of Burley stems were pyrolyzed in an electric furnace at 316° C. for 7 minutes in a nitrogen atmosphere using a wire basket as a container. At the end of the pyrolysis treatment, the Burley stems were immediately cooled by placing the wire basket into a container filled with dry ice. The weight loss of the pyrolyzed Burley stems was measured at 60%.

Analysis of the starting Burley stem material by atomic absorption methods indicated that before pyrolysis, the Burley stems contained 8.5% $K^+$ and 2.62% $Ca^{++}$. The thermally treated material, however, showed upon atomic absorption analysis that the percentages of $K^+$ and $Ca^{++}$ was now 18% and 5.83%, respectively. Accordingly, it was apparent that these metallic ions are not removed by simple pyrolysis and remained in the material. Of course, the difference in relative percentages is attributable to the 60% weight loss.

The pyrolyzed tobacco by-product material was then added to three aliquots of a conventional tobacco-parts slurry. To the first aliquot, 5% of the pyrolyzed tobacco by-product material was added based on the weight of the tobacco material contained in the slurry. Similarly, to the other remaining two aliquots of tobacco-parts slurry, 10 and 15% of the pyrolyzed Burley stems were added, respectively.

The slurry was then homogenized by the use of a Waring blender and then hand-cast into sheets. Handmade cigarettes were then prepared using this material from each of the three samples. They were smoked primarily to determine whether these materials were capable of combustion and at all levels, combustion was indeed achieved.

EXAMPLE 2

100 pounds of tobacco stems were first water extracted to remove the water solubles therefrom by washing them with 2,000 pounds of 50° C. water for a time sufficient to thoroughly wet the stems. The material experienced a weight loss of approximately 25% as a result of the water extraction step. The water extracted material was then dried to a moisture content of 14.0%.

The material was then pyrolyzed by subjecting it to a temperature of 315° C. for 15 minutes in an electric furnace which produced a further weight loss of about 60%. During this thermal treatment, the volatile organic materials were removed by means of vacuum.

The thermally degraded tobacco product was then pulverized in a Waring blender to a particle size of about 100 to 300 mesh. Thereafter, a conventional tobacco-parts slurry was formed. The slurry was then divided into three aliquots. To the first aliquot, Sample A, no additives were added. This sample was used as the control. To the second aliquot, Sample B, 15% activated carbon was added based on the weight of the tobacco material employed in the slurry. Similarly, to the third aliquot of reconstituted tobacco slurry, Sample C, 15% of the thermally degraded tobacco by-product material was added based on the weight of the tobacco material employed in the slurry.

Each of the three samples was then homogenized by a Cowles dissolver.

The resulting slurries were then cast into sheets by means of a steel Sandvik conveyor belt. The sheets were cast to a thickness of about 40–45 mils and then dried to a moisture content of about 14–15% after which the sheets were slit into small shreds. Each of the samples was then combined with natural leaf tobacco to form test cigarettes wherein each of the cigarettes contained 20% of the particular sample and 80% natural leaf tobacco (dry weight basis). The cigarettes were then tested for particulate matter and flavor and aromatic qualities, and the results of that analysis are set forth in Table 1 below.

TABLE 1

| | Sample | | |
|---|---|---|---|
| | A (control) | B (carbon added) | C (pyrolyzed tob. by-prod. added |
| 1. Cigarette Data: | | | |
| Weights (gms/cig) | 1.050 | 1.050 | 1.050 |
| RTD (inch $H_2O$) | 4.5–5.0 | 4.5–5.0 | 4.5–5.0 |
| 2. Smoking Data: | | | |
| TPM (mg/cig) | 22.8 | 20.6 | 17.7 |
| (% reduction) | — | 9.6% | 22.4% |
| $H_2O$ (mg/cig) | 2.7 | 2.2 | 2.3 |
| (% reduction) | — | 18.5% | 14.8% |
| Nicotine (mg/cig) | 1.09 | 0.94 | 0.75 |
| (% reduction) | — | 13.8% | 31.1% |
| TPM (mg/puff) | 2.47 | 2.40 | 2.28 |
| (% reduction) | — | 2.8% | 7.7% |
| Puff Count | 9.2 | 8.6 | 7.8 |
| (% reduction) | — | 6.5% | 15.2% |
| Tar (mg/cig) | 19.01 | 17.46 | 14.65 |
| (% reduction) | — | 8.2% | 22.9% |
| Tar (mg/puff) | 2.06 | 2.03 | 1.88 |
| (% reduction) | — | 1.0% | 8.7% |

Upon review of Table 1, it is seen that Sample C, the sample containing the pyrolyzed tobacco by-product material not only shows a reduction of tar and nicotine over the control sample, but far surpasses the results obtained by the use of activated carbon. Additionally, the flavor and aromatic qualities of Sample C proved to be superior to Samples A and B, particularly as to tobacco-like flavor.

EXAMPLE 3

Example 2 was identically repeated except that the cigarettes formed in this example contained 60% tobacco leaf material with the remainder of each cigarette composed of each of the particular samples prepared in Example 2. Thus, Sample A contained 60% natural leaf tobacco and 40% reconstituted tobacco; Sample B contained 60% natural leaf tobacco and 40% reconstituted tobacco containing activated carbon and finally, Sample C contained 60% tobacco leaf material and 40% reconstituted tobacco containing pyrolyzed tobacco by-product.

The cigarettes formed from these respective samples were tested and the results of the analysis performed are set forth in Table 2 below.

TABLE 2

| | Sample | | |
|---|---|---|---|
| | A (control) | B (carbon added) | C (pyrolyzed tob. by-prod. added) |
| 1. Cigarette Data: | | | |
| Weights (gms/cig) | 1.00 | 1.00 | 1.00 |
| RDT (inch $H_2O$) | 4.5–5.0 | 4.5–5.0 | 4.5–5.0 |
| 2. Smoking Data: | | | |
| TPM (mg/cig) | 19.9 | 18.1 | 17.7 |
| (% reduction) | — | 9.0% | 11.0% |
| $H_2O$ (mg/cig) | 2.4 | 2.3 | 2.2 |
| (% reduction) | — | 4.0% | 8.3% |
| Nicotine (mg/cig) | 1.08 | 1.02 | 0.98 |
| (% reduction) | — | 5.5% | 9.3% |
| TPM (mg/puff) | 2.43 | 2.26 | 2.24 |
| (% reduction) | — | 7.0% | 7.8% |
| Puff Count | 8.2 | 8.0 | 7.9 |
| (% reduction) | — | 2.4% | 3.7% |
| Tar (mg/cig) | 16.42 | 14.78 | 14.52 |
| (% reduction) | — | 10.0% | 11.6% |
| Tar (mg/puff) | 2.00 | 1.85 | 1.84 |
| (% reduction) | — | 7.5% | 8.0% |

As can be seen from Table 2, the sample containing the pyrolyzed tobacco by-product material, as in Example 2, showed a greater reduction in tar and nicotine than the control and showed an even greater reduction in tar over the activated carbon. In addition, it was noted that the greater the amount of pyrolyzed tobacco by-product material used the greater the reduction in undesirable constituents was realized. Moreover, the flavor and aromatic qualities of Sample C produced in this Example was preferred as to the Sample C produced in Example 2 above with respect to total flavor and tobacco-like flavor.

EXAMPLE 4

60 pounds of tobacco by-product plant material consisting primarily of tobacco stems and stalks was thermally degraded without prior water extraction. The thermal treatment was carried out in an electric furnace in which a vacuum had been created such that the pressure was between about 10 to 20 mm Hg. The temperature was kept at 483° C. for 5 minutes. After 5 minutes, the radiant heating elements were shut off and cold nitrogen, from a source of liquid boiling nitrogen, was blown through a work hole into the heating chamber thereby cooling the thermally degraded tobacco by-product material. The thermal treatment produced a weight loss of about 57%.

The thermalized tobacco by-product material was then comminuted, admixed with a slurry of non-thermalized tobacco material, cast, dried and shredded as described in Example 2.

A conventional tobacco-parts slurry was then prepared and divided into three aliquots. To the first aliquot, Sample X, nothing was added thereto, for this sample was to be the control sample. To the second aliquot, Sample Y, 15% of activated carbon was incorporated into the slurry aliquot, based on the weight of the tobacco material employed in said slurry. To Sample Z, 15% of the thermalized tobacco by-product material prepared above was added also based on the weight of the tobacco employed in said slurry.

Each of the respective slurries was then cast, dried and shredded in a manner similar to that described in Example 2. Cigarettes were then prepared from each of the respective samples such that each cigarette contained 86% natural leaf tobacco and 14% of the respective sample material. Each of the cigarettes was then tested for its particulate matter, flavor and aromatic characteristics. The results of that analysis are set forth in Table 3 below.

TABLE 3

| | Sample | | |
|---|---|---|---|
| | X (control) | Y (carbon added) | Z (pyrolyzed tob. by-prod. added) |
| 1. Cigarette Data: | | | |
| Weights (gm/cig) | 1.020 | 1.020 | 1.020 |
| RTD (inch $H_2O$) | 4.0–5.0 | 4.0–5.0 | 4.0–5.0 |
| 2 Smoking Data: | | | |
| TPM (mg/cig) | 21.8 | 19.9 | 19.9 |
| (% reduction) | — | 8.7% | 17.9% |
| $H_2O$ (mg/cig) | 2.2 | 2.1 | 2.1 |
| (% reduction) | — | 4.5% | 4.5% |
| Nicotine (mg/cig) | 1.23 | 1.05 | 0.99 |
| (% reduction) | — | 14.6% | 19.5% |
| TPM (mg/puff) | 2.63 | 2.46 | 2.24 |
| (% reduction) | — | 6.5% | 14.8% |
| Puff Count | 8.3 | 8.1 | 8.0 |
| (% reduction) | — | 2.4% | 3.6% |
| Tar (mg/cig) | 18.39 | 15.75 | 14.81 |
| (% reduction) | — | 14.4% | 19.5% |
| Tar (mg/puff) | 2.22 | 1.94 | 1.85 |
| (% reduction) | — | 12.6% | 16.67% |

As can be seen from Table 3, Sample Z, which contains the pyrolyzed tobacco by-product material produces a greater reduction in tar, nicotine and puff count than the control sample and more importantly, produces results which are better than Sample Y, the sample which contains activated carbon.

The flavor and aromatic qualities of Sample Z had more impact than comparable Samples C of Examples 2 and 3 due to the absence of a water extraction step. It also, however, possessed more total taste and tobacco-like flavor than Samples X and Y, respectively.

EXAMPLE 5

Example 4 was repeated except that the amount of natural leaf tobacco used in the test cigarettes was reduced to 70%. Thus, each of the test cigarettes now contained 70% natural leaf tobacco and 30% of the particular test sample.

The results of the tests performed on these sample cigarettes is set forth in Table 4 below.

TABLE 4

| | Sample | | |
|---|---|---|---|
| | X (control) | Y (carbon added) | Z (pyrolyzed tob. by-prod. added) |
| 1. Cigarette Data: | | | |
| Weights (gm/cig) | 1.05 | 1.05 | 1.05 |
| RTD (inch $H_2O$) | 4.5–5.2 | 4.5–5.2 | 4.5–5.2 |
| 2. Smoking Data: | | | |
| TPM (mg/cig) | 23.3 | 20.6 | 19.2 |
| (% reduction) | — | 11.6% | 17.6% |
| $H_2O$ (mg/cig) | 3.9 | 2.9 | 2.4 |
| (% reduction) | — | 25.6% | 38.5% |
| Nicotine (mg/cig) | 1.22 | 1.02 | 0.84 |
| (% reduction) | — | 16.4% | 31.1% |
| TPM (mg/puff) | 2.68 | 2.48 | 2.37 |
| (% reduction) | — | 7.5% | 11.6% |
| Puff Count | 8.7 | 8.3 | 8.1 |
| (% reduction) | — | 4.6% | 6.8% |
| Tar (mg/cig) | 18.18 | 16.68 | 15.96 |
| (% reduction) | — | 8.3% | 12.2% |
| Tar (mg/puff) | 2.09 | 2.01 | 1.97 |
| (% reduction) | — | 3.8% | 5.7% |

Upon review of Table 4, it is apparent that even at higher levels of addition, Sample Z, the sample which contains the thermalized tobacco by-product material still reduces the undesirable constituents of tobacco better than the control or activated carbon sample. In addition, when comparing Tables 3 and 4, it is seen that the greater the amount of pyrolyzed tobacco by-product material used, the greater the reduction of tar, nicotine and puff count.

The flavor and aromatic qualities of Sample Z were higher rated in overall acceptability, having more tobacco-like taste and more total flavor than Samples X and Y, respectively.

EXAMPLE 6

Example 5 was repeated except that the thermally treated tobacco material in reconstituted tobacco sheet was now compared to a reconstituted tobacco sheet which contained a pyrolyzed cellulosic material exposed to similar heat treatment, resulting in comparable weight loss (about 60%).

The results of the tests performed on these sample cigarettes are set forth in Table 5 below.

TABLE 5

| | Sample | | |
|---|---|---|---|
| | X (control) | Y (pyrolyzed cellulose added) | Z (pyrolyzed tob. by-product added) |
| 1. Cigarette Data: | | | |
| Weights (gm/cig) | 1.04 | 1.04 | 1.04 |
| RTD (inch $H_2O$) | 4.5–5.0 | 4.5–5.0 | 4.5–5.0 |
| 2. Smoking Data: | | | |
| TPM (mg/cig) | 23.1 | 21.9 | 19.1 |
| (% reduction) | — | 5.2% | 17.3% |
| $H_2O$ (mg/cig) | 3.6 | 3.1 | 2.7 |
| (% reduction) | — | 13.9% | 25.0% |
| Nicotine (mg/cig) | 1.21 | 1.16 | 0.83 |
| (% reduction) | — | 4.1% | 31.4% |
| TPM (mg/puff) | 2.68 | 2.61 | 2.36 |
| (% reduction) | — | 2.61% | 11.9% |
| Puff Count | 8.6 | 8.4 | 8.1 |
| (% reduction) | — | 2.3% | 5.8% |
| Tar (mg/cig) | 18.29 | 17.64 | 16.57 |
| (% reduction) | — | 3.6% | 9.4% |
| Tar (mg/puff) | 2.13 | 2.10 | 2.05 |
| (% reduction) | — | 1.4% | 3.8% |

Table 5 shows that the incorporation of thermally treated tobacco by-products into reconstituted tobacco sheet in Sample Z gives far better results in terms of reducing TPM, tar and nicotine compared to thermally treated cellulose added at the same level to reconstituted tobacco sheet as in Sample Y. Besides the more desirable analytical properties of Sample Z, it had significantly higher subjective rating on smoking panel for its superior flavor and aromatic qualities especially having more total taste and tobacco-like flavor. Sample Y was judged as having off-flavor.

EXAMPLE 7

Example 6 was repeated except that Sample Y was fabricated using 30% reconstituted tobacco sheet with such a heat treated pyrolyzed tobacco by-product at the same level that was washed previously. The washing in this case was done with twenty times the weight of water at 50° C. (In other experiments water extractions up to 99° C. were used with a soaking which lasted for as much as a day.) Each cigarette contained 70% natural leaf tobacco and 30% reconstituted tobacco sheet material. Sample Z was identical in composition to Sample Z in Example 6.

The results of the test performed on these sample cigarettes are presented in Table 6 as follows:

TABLE 6

| | Sample | | |
|---|---|---|---|
| | X (control) | Y (washed pyrolyzed tobacco by-product) | Z (non-washed pyrolyzed tobacco by-product) |
| 1. Cigarette Data: | | | |
| Weights (gm/cig) | 1.035 | 1.035 | 1.035 |
| RTD (inch $H_2O$) | 4.4–5.0 | 4.4–5.0 | 4.4–5.0 |
| 2. Smoking Data: | | | |
| TPM (mg/cig) | 23.0 | 21.7 | 19.1 |
| (% reduction) | — | 5.7% | 17.0% |
| $H_2O$ (mg/cig) | 3.3 | 3.0 | 2.4 |
| (% reduction) | — | 9.1% | 27.3% |
| Nicotine (mg/cig) | 1.22 | 1.09 | 0.82 |
| (% reduction) | — | 10.7% | 32.8% |
| TPM (mg/puff) | 2.67 | 2.58 | 2.39 |
| (% reduction) | — | 3.4% | 10.5% |
| Puff Count | 8.6 | 8.4 | 8.0 |
| (% reduction) | — | 2.3% | 7.0% |
| Tar (mg/cig) | 18.48 | 17.61 | 15.88 |
| (% reduction) | — | 4.7% | 14.1% |
| Tar (mg/puff) | 2.14 | 2.1 | 1.99 |
| (% reduction) | — | 1.9% | 7.0% |

It should be noted that subjectively the "Y" cigarette was milder while the "Z" sample had more total taste and more impact.

Variations and modifications may, of course, be made without departing from the spirit and scope of the present invention.

Having thus described our invention, what we desire to secure by Letters Patent is:

1. A method of producing a smokable material comprising:

(a) subjecting a material consisting essentially of tobacco by-products to uncatalyzed pyrolysis to produce a weight loss of about 40 to 90%;

(b) adding the pyrolyzed material to a slurry consisting essentially of tobacco-parts;

(c) homogenizing the slurry; and (d) drying.

2. The method of claim 1, wherein the tobacco by-product material is selected from the group consisting of tobacco stems, stalks, dust, fines and blends thereof.

3. The method of claim 1, wherein the pyrolysis is carried out at a temperature of about 150° C. for about 72 hours to a temperature of about 700° C. for about 30 seconds.

4. The method of claim 1, wherein the heating source for the pyrolysis step is derived from radiant heat, gas heat, oil heat, steam, electricity or microwave energy.

5. The method of claim 1, wherein the pyrolysis is carried out in an inert atmosphere.

6. The method of claim 5, wherein the inert atmosphere is comprised of nitrogen, carbon dioxide, helium, or a vacuum.

7. The method of claim 1, wherein prior to step (a), the tobacco by-product material is water extracted to remove water soluble constituents therefrom.

8. The method of claim 7, wherein potassium salts are removed.

9. The method of claim 1, wherein during the pyrolysis of the tobacco by-product material, volatile organic materials produced as a result of the pyrolysis are removed by vacuum.

10. The method of claim 1, wherein subsequent to step (a) and prior to step (b), the pyrolyzed tobacco by-product material is immediately cooled.

11. The method of claim 1, wherein prior to adding the pyrolyzed material to the tobacco parts slurry, the said material is pulverized.

12. The method of claim 11, wherein the pyrolyzed tobacco by-product material is pulverized by means of dry or wet grinding.

13. The method of claim 1, wherein up to 75% on a dry weight basis of the pyrolyzed tobacco by-product material is added to the tobacco-parts slurry.

14. The method of claim 1, where in step (d), the homogenized slurry is formed into a sheet by means of a paper-making process, dried and shredded.

15. The method of claim 1, where in step (d), the homogenized slurry is cast into a sheet, dried and shredded.

16. The method of claim 14, wherein the shredded smoking material is combined with natural leaf tobacco.

17. The method of claim 15, wherein the shredded smoking material is combined with natural leaf tobacco.

18. A method of producing a smokable material comprising:

(a) water extracting tobacco by-product material to remove water soluble constituents therefrom;

(b) pyrolyzing the water extracted tobacco by-product material to a weight loss of about 40 to 90%;

(c) pulverizing the pyrolyzed tobacco by-product material;

(d) adding about 0.08 to 60% on a dry weight basis of the pulverized material to a tobacco-parts slurry;

(e) homogenizing the slurry; and (f) processing the slurry into sheet form and drying and shredding the resultant product.

19. A smokable material comprising tobacco by-product material pyrolyzed to a weight loss of about 40 to 90% homogenized with reconstituted tobacco.

20. The material of claim 19, wherein the tobacco by-product material is selected from the group consisting of tobacco stems, stalks, dust, fines and blends thereof.

21. The material of claim 19, wherein the pyrolyzed tobacco by-product is substantially devoid of potassium salts.

22. The material of claim 19 containing up to 75% on a dry weight basis of pyrolyzed tobacco by-product materials.

* * * * *